US006471778B1

(12) United States Patent
Baltz et al.

(10) Patent No.: US 6,471,778 B1
(45) Date of Patent: Oct. 29, 2002

(54) ELECTROSTATIC COATING SYSTEM WITH COATING MATERIAL CHILLER AND METHOD THEREFOR

(75) Inventors: James P. Baltz, Waterville, OH (US); Dennis P. Stephens, Toledo, OH (US)

(73) Assignee: Illinois Tool Works Inc., Glenview, IL (US)

( * ) Notice: Subject to any disclaimer, the term of this patent is extended or adjusted under 35 U.S.C. 154(b) by 98 days.

(21) Appl. No.: 09/591,000

(22) Filed: Jun. 9, 2000

(51) Int. Cl.[7] ..... B05B 5/025

(52) U.S. Cl. ..... 118/620; 118/621; 118/600; 239/690; 239/708

(58) Field of Search ..... 118/620, 75, 621, 118/308, 722, 600, 667, 688; 222/146.6; 427/421, 458, 469; 62/4, 308, 331, 903, 904; 165/74, DIG. 349, DIG. 350, 142; 239/690, 708

(56) References Cited

U.S. PATENT DOCUMENTS

| | | | | |
|---|---|---|---|---|
| 2,645,461 A | | 7/1953 | Brown et al. | |
| 2,657,473 A | | 11/1953 | Montgomery et al. | |
| 2,835,477 A | | 5/1958 | Tovrog et al. | |
| 3,729,948 A | | 5/1973 | Schwartz | |
| 4,109,027 A | * | 8/1978 | Crose | 118/621 |
| 4,246,955 A | | 1/1981 | Skala | |
| 5,320,163 A | | 6/1994 | Stoodley | |
| 5,487,782 A | * | 1/1996 | Seewaldt | 118/621 |
| 5,768,894 A | | 6/1998 | Li et al. | |
| 5,878,811 A | | 3/1999 | Falzone | |

FOREIGN PATENT DOCUMENTS

| | | | | |
|---|---|---|---|---|
| JP | 404330961 A | * | 11/1992 | 118/667 |

OTHER PUBLICATIONS

Deft, Inc., "The Chiller" Sales Brochure, 1 page.
ITW Randburg, "AquaTank" web page "www.ransburg.com", 1 pg. Mar. 9, 2000.
ITW Vortec, "Vortex Tubes & Cold Air Guns" brochure, 2 pgs.

* cited by examiner

*Primary Examiner*—Richard Crispino
*Assistant Examiner*—Kevin P. Shortsle
(74) *Attorney, Agent, or Firm*—John H. Pilarski; Mark W. Croll

(57) ABSTRACT

An electrostatic coating system for dispensing multi-component waterborne coating materials from a coating material supply container having an insulated outer portion and a coating material supply line coupled to a dispenser, a metal tube disposed in the container in contact with coating material therein, a first non-conductive fitting coupling a first end portion of the tube to a first opening of the container, a second non-conductive fitting coupling a second end portion of the tube to a second opening of the container, and a cooling fluid supply device coupled to the tube.

15 Claims, 1 Drawing Sheet

ELECTROSTATIC COATING SYSTEM WITH COATING MATERIAL CHILLER AND METHOD THEREFOR

BACKGROUND OF THE INVENTION

The invention relates generally to electrostatic coating systems, and more particularly to electrostatic coating systems that dispense multi-component liquid coating materials and methods therefor.

Systems that dispense electrostatically charged and atomized coating materials from a spray applicator or other dispenser coupled to a high voltage source are known generally. The coating material is generally supplied from a supply container, which may or may not be pressurized.

Some coating materials dispensed from electrostatic systems are multi-component waterborne materials that react with each other and over time harden. The rate of reaction is generally dependent upon the properties of the components and on the temperature thereof. Upon hardening, multi-component coating materials are unsuitable for spray application by electrostatic systems and become waste. The useable liquid state of the coating material prior to hardening is known as its pot life.

An object of the present invention is to provide novel electrostatic coating systems and methods therefor that overcome problems in and improve upon the prior art.

Another object of the invention is to provide novel electrostatic coating systems and methods therefor that are economical and reliable.

Another object of the invention is to provide novel electrostatic coating systems that dispense multi-component liquid coating materials having improved pot life and methods therefor.

Another object of the invention is to provide novel electrostatic coating systems that dispense multi-component liquid coating materials supplied from pressurized supply containers and methods therefor.

Yet another object of the invention is to provide novel electrostatic coating systems that dispense multi-component liquid coating materials at relatively high voltages from a supply container and methods therefor.

Still another object of the invention is to provide novel electrostatic coating systems that dispense multi-component liquid coating materials maintained at reduced temperatures in a supply container and methods therefor.

A more particular object of the invention is to provide novel electrostatic coating systems for dispensing multi-component waterborne coating materials comprising a coating material supply container having an insulated outer portion and a coating material supply line coupled to a dispenser, a metal tube disposed in the container in contact with coating material, a first non-conductive fitting coupling a first end portion of the tube to a first opening of the container, a second non-conductive fitting coupling a second end portion of the tube to a second opening of the container, and a cooling fluid supply device coupled to the tube for supplying a cooling fluid thereto.

Another more particular object of the invention is to provide novel improvements in electrostatic coating systems that dispense multi-component liquid coating materials supplied at a high voltage from a container electrically isolated from ground, comprising a cooling fluid tube disposed in a portion of the container where at least a portion of the tube contacts coating material disposed therein, the cooling fluid tube having a first end portion coupled to a first opening in the container and a second end portion coupled to a second opening in the container, the cooling fluid tube is electrically insulated from an outer portion of the container.

Yet another more particular object of the invention is to provide novel methods for electrostatic systems comprising dispensing a multi-component waterborne coating material from a dispenser at a high voltage, supplying the multi-component waterborne coating material from a non-conductive container to the dispenser, cooling the multi-component waterborne coating material in the container by supplying a cooling fluid through a tube disposed at least partially in the multi-component waterborne material, and electrically isolating the tube from an outer portion of the container.

These and other objects, aspects, features and advantages of the present invention will become more fully apparent upon careful consideration of the following Detailed Description of the Invention and the accompanying Drawings, which may be disproportionate for ease of understanding, wherein like structure and steps are referenced generally by corresponding numerals and indicators.

DETAILED DESCRIPTION OF THE INVENTION

Figure 1:
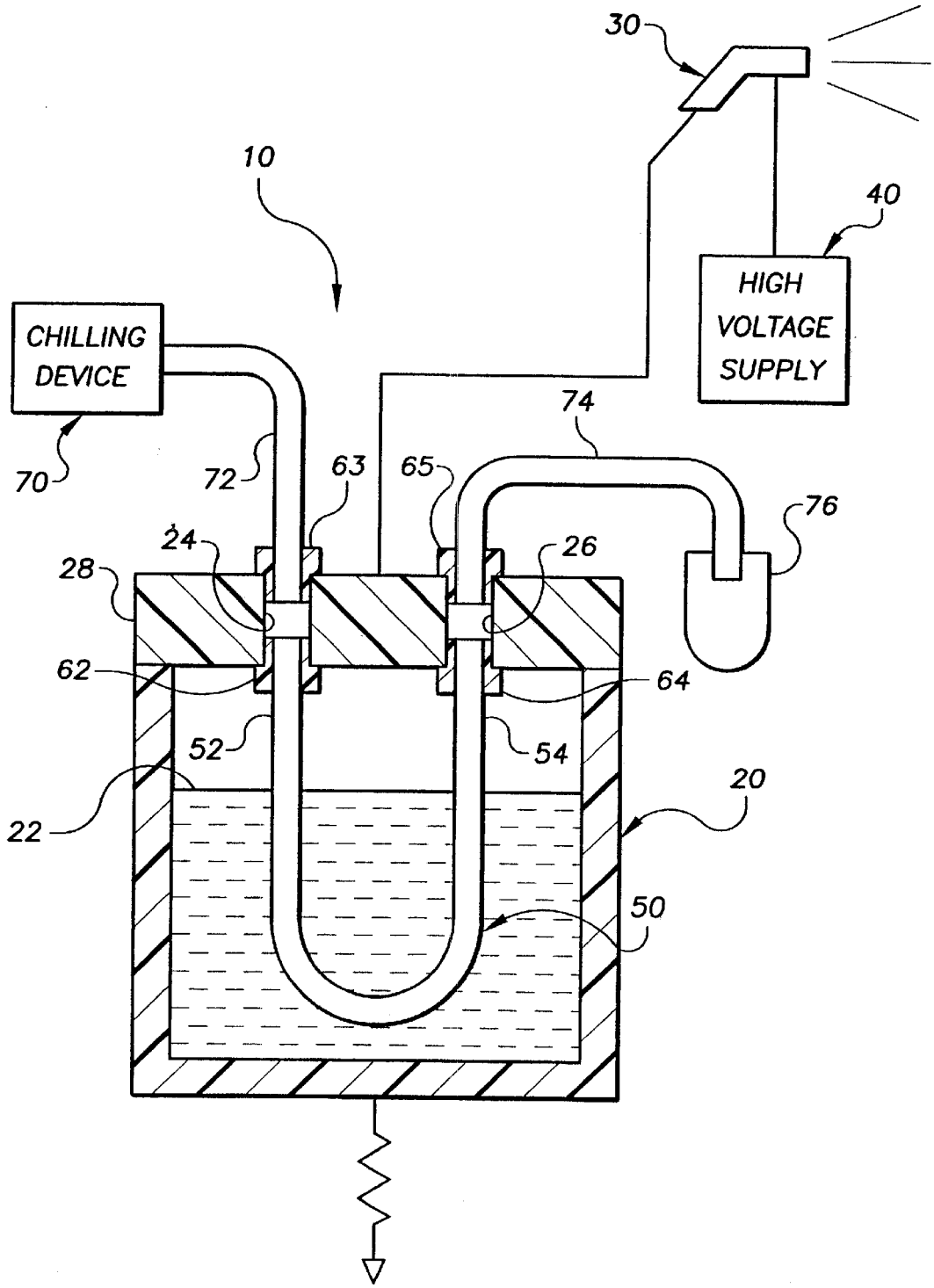
FIG. 1 is an electrostatic coating system according to an exemplary embodiment of the invention.

FIG. 1 is an electrostatic coating system 10 for dispensing multi-component waterborne coating materials. The system 10 generally comprises a coating material container 20 that supplies coating material 22 therefrom though a supply line to a spray applicator or some other dispensing device 30 coupled to a high voltage supply 40.

In some electrostatic coating systems, including the system in the exemplary embodiment of FIG. 1, the coating material container is not electrically isolated from the high voltage dispenser. In these systems, the coating material in the supply container is also at a high voltage and must therefore be isolated from electrical ground.

One known electrically isolating coating material container suitable for use with the present invention is the AQUATANK, by ITW Ransburg Corporation, Toledo, Ohio. The AQUATANK is an isolation chamber having an insulated outer portion that isolates high voltage coating materials therein from electrical ground. The exemplary AQUATANK container is also pressurized to supply coating material therefrom under pressure to a spray applicator or to some other dispensing device through a shielded supply line.

The system of the present invention also comprises a cooling fluid tube, at least a portion of which is disposed in a portion of the container where it contacts the coating material disposed therein to withdraw heat therefrom, as discussed further below. The cooling fluid tube has a first end portion coupled to a first opening in the container and a second end portion coupled to a second opening in the container.

In applications where the coating material in the container is not electrically isolated from the high voltage dispenser, as in the exemplary system, the container is preferably an electrically isolating container, for example the AQUATANK container discussed above, and the tube is preferably electrically insulated or isolated from an outer portion of the container.

The tube is preferably a metal material having good thermal conduction and little or no tendency to react chemically with the coating material disposed in the container. In one embodiment, the tube comprises a 316 stainless steel material.

In the exemplary embodiment of FIG. 1, the metal tube 50 is in the form of a partially coiled U-shape member. The tube 50 includes first and second end portions 52 and 54 that are coupled to corresponding first and second openings 24 and 26 in a container cover portion 28. In other embodiments, the tube may have multiple coils, and the end portions thereof may be coupled to portions of the container other than the cover.

The first end portion 52 of the tube is preferably coupled to the first opening of the container 20 by a first non-conductive fitting 62, and the second end portion 54 of the tube is preferably coupled to the second opening of the container by a second non-conductive fitting 64. In the exemplary embodiment, the non-conductive fittings are compression fittings made from a non-conductive material, for example DELRIN.

Non-conductive compression fittings suitable for use with the present invention are available, for example, from SWAGELOK.

The system 10 also comprises a cooling fluid supply device 70 coupled to one of the first and second end portions of the tube, preferably by a non-conductive cooling fluid supply line 72 coupled to one of the first and second openings of the container.

In the exemplary embodiment, the supply line 72 is coupled to the first opening 24 of the container 20 by a fitting 63, which is preferably an insulated or non-conducting compression fitting of the type described above.

The cooling fluid supply device 70 is preferably a vortex air cooling device that supplies cooled air to and through the metal tube 50 in the container.

A known vortex air cooling device suitable for use with one contemplated application of the present invention is the Vortex Tube Model No. 106-4-H by ITW Vortec, Cincinnati, Ohio. In other embodiments, alternative fluid chillers may be used.

The exemplary system 10 also comprises a discharge line 74 coupled to the second end portion 54 of the tube 50 for discharging fluid circulated through the tube 50. In the exemplary embodiment, the discharge line 74 is coupled to the second opening 26 of the container by a corresponding insulated compression fitting 65.

In some applications, the cooling fluid is discharged into protected receptacle 76 for collecting the cooling fluid, which may become very hot upon circulation through the coating material in the container.

While the foregoing written description of the invention enables one of ordinary skill to make and use what is considered presently to be the best mode thereof, those of ordinary skill will understand and appreciate the existence of variations, combinations, and equivalents of the specific exemplary embodiments herein. The invention is therefore to be limited not by the exemplary embodiments herein, but by all embodiments within the scope and spirit of the appended claims.

What is claimed is:

1. An electrostatic coating system for dispensing multi-component waterborne coating materials, comprising:

a high voltage electrostatic coating material dispenser;

a coating material supply container having an insulated outer portion and a coating material supply line coupled to the dispenser, the container having first and second openings therein;

a metal tube having first and second end portions, at least a portion of the tube disposed in a portion of the container where the tube is contactable with coating material disposed in the container;

a first non-conductive fitting coupling the first end portion of the tube to the first opening of the container, and a second non-conductive fitting coupling the second end portion of the tube to the second opening of the container;

a cooling fluid supply device coupled to one of the first and second end portions of the tube.

2. The system of claim 1, the cooling fluid supply device comprises a non-conductive cooling fluid supply line coupled to one of the first and second openings of the container.

3. The system of claim 1, the container comprises a coating material disposed therein, the coating material is not electrically isolated from the high voltage dispenser.

4. The system of claim 1, the first and second non-conductive fittings are compression fittings.

5. The system of claim 4, the container is a pressurized container.

6. The system of claim 1, the container includes a cover portion having the the first and second openings therein.

7. The system of claim 1, the metal tube is a 316 stainless steel.

8. The system of claim 1, the cooling fluid supply device is a vortex air cooling device.

9. The system of claim 1, a portion of the metal tube at least partially coiled.

10. In an electrostatic coating system that dispenses multi-component liquid coating materials supplied at a high voltage from a container electrically isolated from ground, the improvement comprising:

a cooling fluid tube disposed in a portion of the container where at least a portion of the tube contacts coating material disposed therein, the cooling fluid tube having a first end portion coupled to a first opening in the container, the cooling fluid tube having a second end portion coupled to a second opening in the container, the cooling fluid tube electrically insulated from an outer portion of the container.

11. The improvement of claim 10, the container is an insulated isolation chamber, the cooling fluid tube is a metal tube, a first non-conductive fitting coupling the first end portion of the cooling fluid tube to the first opening of the container, and a second non-conductive fitting coupling the second end portion of the cooling fluid tube to the second opening of the container.

12. The improvement of claim 11, the cooling fluid tube is a 316 stainless steel.

13. The improvement of claim 11, a cooling fluid supply device coupled to one of the first and second end portions of the cooling fluid tube.

14. The improvement of claim 13, the cooling fluid supply device coupled to the cooling fluid tube by a non-conductive supply line coupled to one of the first and second openings of the container.

15. The improvement of claim 14, the cooling fluid supply device is a vortex air cooling device.

* * * * *